United States Patent [19]

Vander Jagt

[11] Patent Number: 4,805,842

[45] Date of Patent: Feb. 21, 1989

[54] ROTARY MACE ADAPTER BLOCK

[76] Inventor: A. Dean Vander Jagt, P.O. Box 190, Bay City, Mich. 48707

[21] Appl. No.: 43,110

[22] Filed: Apr. 27, 1987

[51] Int. Cl.[4] ..... B02C 13/26; B02C 13/28

[52] U.S. Cl. ..... 241/194

[58] Field of Search ..... 241/191, 193, 194, 300

[56] References Cited

U.S. PATENT DOCUMENTS 1,892,697 1/1933 Elzemeyer et al. ..... 241/193

1,974,647 9/1934 Hagmaier ..... 241/193

*Primary Examiner*—Timothy V. Eley

*Attorney, Agent, or Firm*—Edward E. Schilling; Timothy S. Stevens

[57] ABSTRACT

An improved rotary mace for striking off extraneous transient projections from, e.g., ferrous castings, the mace having a hub, at least one hammer and means for pivotably securing each of the at least one hammers to the hub, the improved means for securing the hammers including an adapter block for the hammers, each adapter block being removably fixedly attached to a peripheral face of the hub and the hammer being removably pivotably attached to the adapter block, e.g., by a clevis. Preferably, each hammer is supported upon a respective adapter block and each adapter block is provided with means for holding resilient bumper means positioned to receive the impact of the pivotable hammer at either maximal pivotable position. The novel adapter block also has secure fastening means for releasably securing the means for pivotably attaching each hammer.

14 Claims, 2 Drawing Sheets

Fig. 1
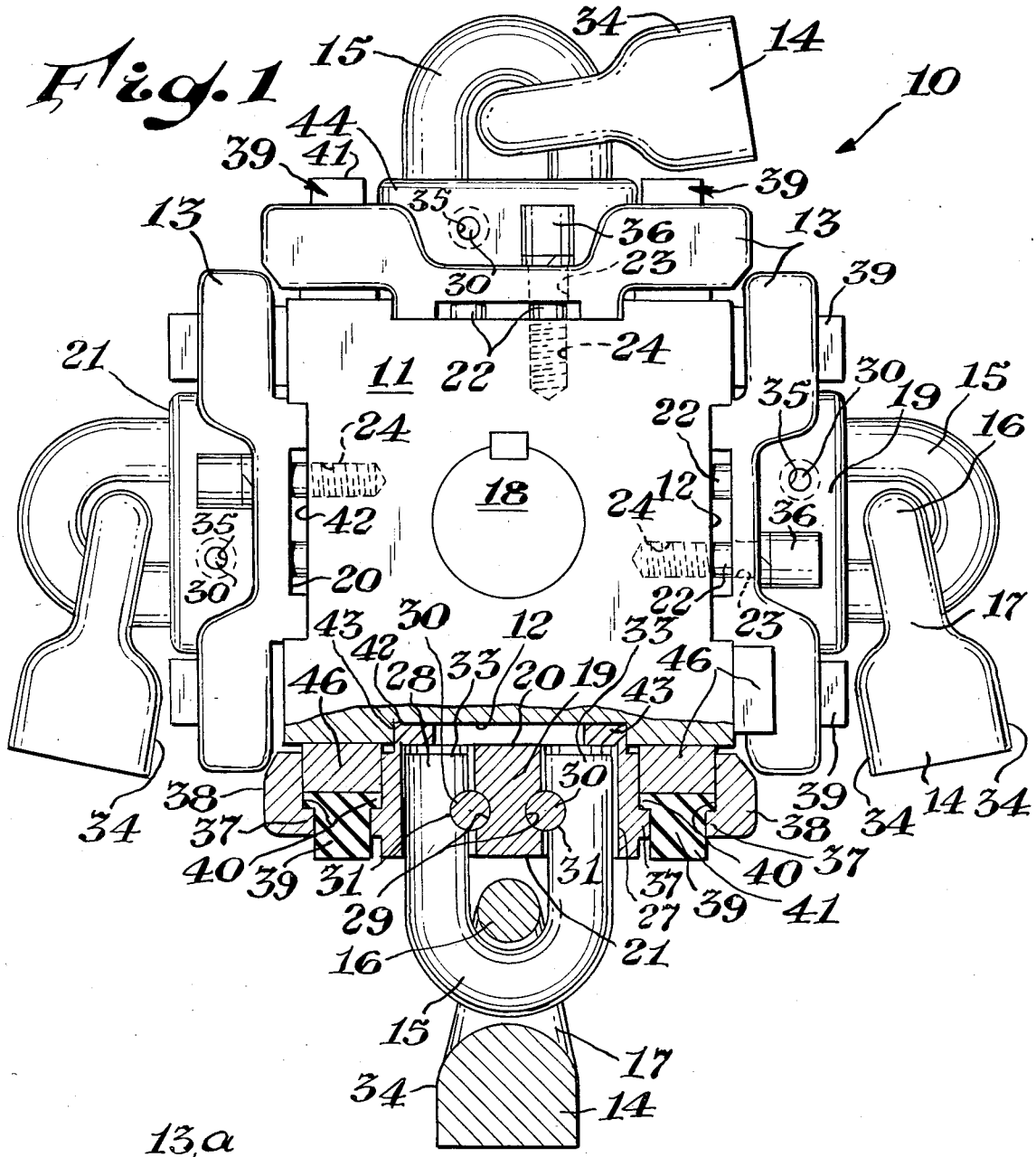
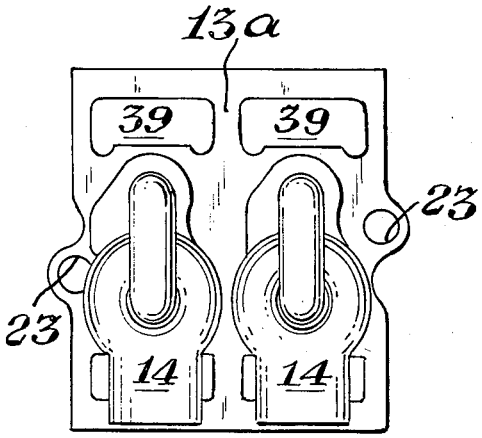
Fig. 3
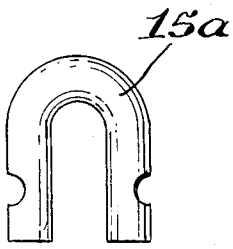
Fig. 4
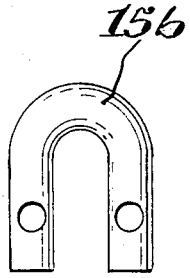
Fig. 5

ROTARY MACE ADAPTER BLOCK

FIELD OF THE INVENTION

This invention is in the field of rotatable devices for removing unwanted transient projections, such as flashings, gates and risers from metal castings and is more specifically directed to improvements in the so-called rotary mace.

BACKGROUND OF THE INVENTION

Ferrous and non-ferrous castings are widely used in, for example, the automotive industry. The casings can be produced in high volume by pouring the molten metal into a series of sand-based molds and then letting the metal cool and harden. The fresh, i.e., newly made, castings are then removed from the mold and further processed by, for example, removing any unwanted transient projections resulting from the casting procedure.

Traditionally, these unwanted projections were knocked off manually with a hammer or a cold chisel and hammer. Modern production methods emphasize mechanized systems for rapidly removing the unwanted projections from castings on a volume basis and a rotary mace with pivotable hammers has been used commercially in the automotive industry to process castings such as cast iron engine heads.

The rotary mace previously used is a rotatable device usually made largely or entirely of steel, having a number of hammers ordinarily formed of tool steel, each pivotably attached by means of an eye at the end of the shank of the hammer through which is passed a steel clevis having notched legs that are locked into a face of a polygonal rotatable steel body called a hub. Each hub face is provided with the requisite number of boreholes extending radially inward into the face to receive the notched legs of the clevises. The hub is also bored axially from the ends thereof to provide a sufficient number of boreholes for retaining pins used to secure the legs of the clevises. Each axial borehole lies in a direction approximately parallel to the axis of the hub and adjacent to a hub face, and transversely to the radial borehole receiving a leg of one of the clevises so as to intersect only a portion of a clevis leg-receiving borehole. A pin is inserted through each such axially directed bore to intercept an aligned notch in a clevis leg, thus providing a retaining means for the clevis. The pins have usually been retained in the hub by bolting a ring shaped cover piece or collar to each end face of the hub so that the ring shaped pieces cover the pin bore openings after the pins have been inserted. Fresh castings are passed appropriately near the rotating rotary mace so that the pivotable hammers impact the unwanted projections on the castings and knock them off. Durable, resilient plastic bumpers or pads are attached to the circumferential hub faces on either side of the hammers along a circumferential line to prevent the pivoting hammers from damaging the hub as the hammers bounce or recoil off a casting during rotation of the mace.

The rotary mace was a successful development over manual operations. However, it is in need of improvement. Boring the boreholes in the hub parallel to the axis thereof to receive the locking pins for the clevis legs is expensive because of the linear length of the holes required to hold an array of clevises to hold a row of hammers as desired. This problem could be lessened by making the hub in narrow or somewhat discate segments, but then it would be necessary to bolt the segments together along the common axis, increasing the complexity of the hub, so this answer was not widely adopted. Replacing worn out or badly deformed hammers from a single hub carrying a plurality of hammers required driving out the elongated locking pins which are often wedged fast in their bores by accumulated dirt and sand picked up during normal operations. Driving too hard on a wedged pin often upset the driven end of the pin to such a degree that drilling the pin out would be about the only means of recovering the hub to place it back in service. Occasionally a bumper would be dislodged from the hub and the hub face would be promptly damaged, necessitating expensive refinishing or repair before a replacement bumper could be installed.

SUMMARY OF THE INVENTION

The invention in one aspect is an improvement in the rotary mace of the type described capable of carrying a plurality of hammers on the exterior of a hub, the improvement being that substantially each hammer is pivotably attached to an adapter block which is in turn fixedly attached to the surface of the hub of the rotary mace. Preferably the adapter block is shaped so that a series thereof nest together efficiently side by side in at least one but preferably two or more rows across the surface of the hub in a direction parallel to the axis of the hub. The invention in an additional aspect is an improved rotary mace in which a plurality of hammers are each held in two or more rows on the circumferential surface of the hub. In yet another aspect, the invention contemplates a novel adapter block for mounting a hammer pivotably and removably on the surface of the hub of a rotary mace.

BRIEF DESCRIPTION OF THE DRAWINGS

FIG. 1 is an end view, partly in full and partly broken away and in section, of an improved rotary mace showing four hammer-clevis-adapter block assemblies attached to the hub of a rotary mace;

FIG. 3 is a view in front elevation of another form of clevis;

FIG. 4 is a view in front elevation of another form of clevis; and

FIG. 5 is a plan view of a double wide type adapter block.

DETAILED DESCRIPTION OF THE INVENTION

Figure 2:
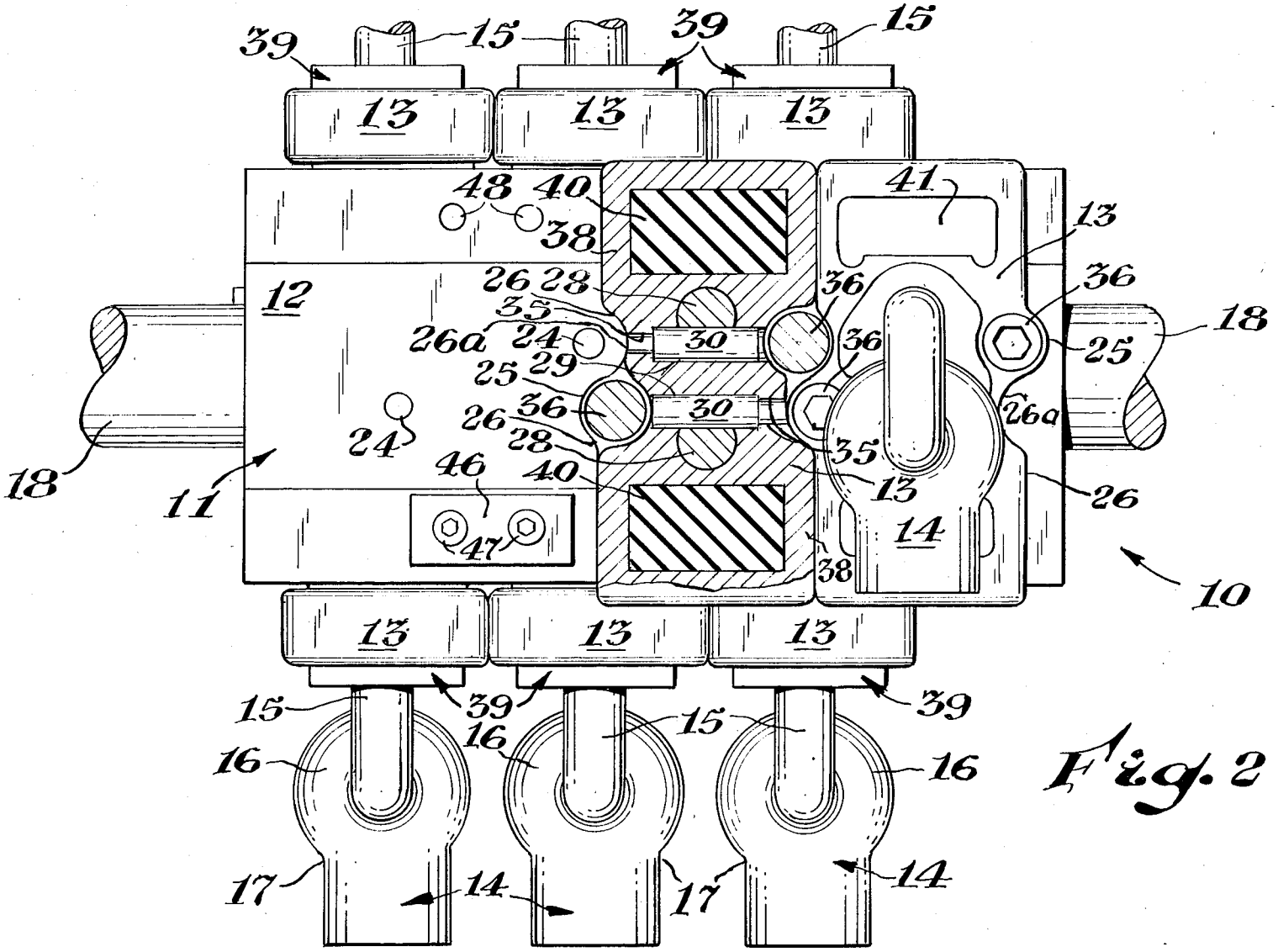
FIG. 2 is a view in front elevation, partly in full and partly broken away and in section, with yet another portion truncated to accommodate spacing on the sheet, showing a mace with nested side-by-side hammer-clevis-adapter block assemblies on a plurality of hub faces, and together with FIG. 1 illustrating a number of the present novel adapter blocks for attaching pivotable hammers to the hub of a rotary mace.

In the following description, substantially identical elements are identified by like reference numerals.

Refering to FIG. 1, therein is shown, in end view, an improved rotary mace indicated generally by the numeral 10. The rotary mace 10 as here illustrated comprises a rotatable body or hub 11 having a peripheral face, usually the hub being polygonal in section and having an axis of rotation and four or more substantially flat indented faces 12, on one or more of which is fixedly mounted, but typically disposed in weight balanced array as to the mace, one or more adapter blocks 13, each pivotably carrying a foreshortened hammer 14 by mounting means such as a clevis 15 and a ring 16 integrally formed with the shank 17 of the hammer 14, with the clevis 15 extending through the ring 16. Other details of the shape of a suitable hammer for use on castings may be seen more clearly in FIG. 2. The hammer 14 and the clevis 15 of the conformation shown provide for a largely universal freedom of pivoting by the hammer although it would be minimally sufficient to provide a mount in which the hammer is free to oscillate or pivot substantially only in the direction of rotation of the hub 11.

The hub 11 is mounted, usually keyed, on an axial shaft 18 driven by most any suitable motor means, not shown, such as an electric motor of suitable power.

Referring now more particularly to FIG. 2, there is shown a view of an improved mace of the invention with one face in front elevation and two other faces tangentially, with hammer-clevis-adapter block assemblies in a row on each face indicated. On one of the faces appearing only tangentially, the assemblies have been truncated to accommodate the space available on the sheet. On the face seen in front elevation, one assembly is shown in full, the next adjacent assembly is shown partly broken away and in section, while the space for a third adjacent adapter block is shown with the adapter block removed to show the underlying face 12, a spacer 46 and other features later more fully described.

Each of the adapter blocks 13, as seen in both FIGS. 1 and 2, consist of a central body portion 19 having a face 20 which substantially contacts a hub face 12, and an opposed face 21, into which a clevis 15 extends. The adapter blocks 13 are each removably but fixedly attached to a hub face 12, for example, with bolts 22 that extend through boreholes 23 in the body portion 19 of the adapter block 13 and into tapped holes 24, some of which are indicated in dotted outline, in a face 12 of the hub 11. Preferably, the body portion 19 of each adapter block 13 is provided with a rounded, laterally extending flange 25 and adjacent recess **26*a* on each lateral edge 26 of the central body portion 19, i.e., the flanges and receses each being offset as to the other from side to side of the central body portion 19, so the adapter blocks 13 can be readily nested together side-by-side as shown in FIG. 2, providing for a close spaced array of hammers 14 in each row, as typically desired for best operation in processing castings. In addition, as shown in FIG. 2, the adapter blocks 13 on one face 12 of the hub 11 are preferably staggered in their placement relative to the next face 12 so that a complete area is swept by the hammers 14 during rotation of the mace 10**.

Twin boreholes 27 are provided in the central body portion 19 of each adapter block 13, extending through the opposed face 21 towards face 20 and spaced apart and aligned to receive the legs 28 of a clevis 15, the openings of the boreholes 27 for each clevis preferably being aligned substantially along a peripheral line in the direction of rotation of the rotary mace 10 in order in position the hammers in a closer spaced series in each row on a given hub face, although the clevis legs in each case can be positioned transversely to the direction of rotation if desired.

The clevises 15 may be attached to each adapter block 13 by most any suitable fastening means. A preferred means utilizes boreholes 29 that extend laterally between lateral edges of the central body portion 19 of each adapter block 13 to receive retaining pins 30 that intercept notches 31 in each clevis leg 28 of each clevis 15. Preferably, there is a notch 31 in each clevis leg 28 for the most secure mounting and conveniently the notches 31 are each formed in the face between each leg, i.e., opposing the other leg of the same clevis, and adjacent the distal ends 33 of the legs 28.

If desired, the notches in the legs of the clevises may be formed on the outward face portion of each leg 28, instead of between the respective legs, as shown for example in FIG. 4 reference numeral **15*a*, and the boreholes 29 aligned accordingly so that the retaining pins 30 intercept the notches in such location, or, the legs 28 may be pierced transversely, as shown for example in FIG. 5 reference numeral 15*b*, and the retaining pins 30 aligned to extend therethrough the legs 28**.

The hammer 14, as indicated, may have most any shape desired that will serve as a hammer and may be pivotably attached to the adapter block 13 by most any suitable means. Preferably, the hammer 14 used in each combination is one having a considerably foreshortened or nearly absent shank 17 merging into a ring portion 16 that engages a clevis 15.

If desired, the hammer 14 may be attached to the clevis 15 by any other suitable means such as a chain link or by a stranded wire rope. The hammer shank may also have the shape of parallel legs sufficiently divergent to straddle the clevis or an eye bolt and attachment can be made by a pin or bolt extending through aligned boreholes in the distal ends of the legs and passing between the legs of the clevis or through an eye bolt, as may be utilized. The clevis or similar means can also be integrally formed with the block 13 if desired.

In the apparatus shown, referring particularly to FIG. 2, and to the adapter block 13 there shown mostly in section, the lateral boreholes 29 preferably and conveniently do not extend full bore entirely through the central body portion 19 of the adapter block 13, but have a short, smaller diameter borehole portion 35 adjacent the lateral edge 26 of the central body portion 19 that serves as a stop in each case for the retaining pin 30, while the smaller borehole portion permits ready insertion of a smaller diameter punch for the purpose of driving out and removing the retaining pin 30 when it is desired to remove the clevis 15 when disassembling the apparatus.

Additionally, upon forming the rounded lateral flange 25 in substantially each instance at an appropriate location along the lateral edge 26 of the central body portion 19 so as to align with a lateral borehole 29, the means for fastening the adapter block 13 to the hub 11 may take the form of one or more bolts 22, but preferably two. Most preferably there is a sufficiently upstanding head 36 on each bolt 22 to serve as a blocking means to prevent the aligned retaining pin 30 next to it from slipping or working out of its transverse or lateral borehole 29 and thus out of engagement with a notch 31 in a clevis leg 28. Instead of using cylindrical retaining pins 30, the notched clevis 15 may also be retained by transversely extending bolts fitting into tapped boreholes in the central body portion 19, or, tapered pins or pins that are not round, but are, e.g., square in section, may be used with complementary notches in the clevis legs.

To prevent rapid or undue damage by the head 34 of the hammer 14 striking any other vulnerable portion of the mace during use, the adapter block 13 is preferably formed with means for holding a resilient pad or bumper 39 at the alternate positions where the hammer head 34 normally contacts other parts when reaching the maximum pivotal position during use. These alternate positions are located along a peripheral line around the mace 10 in the direction of rotation of the mace, longitudinally aligned with the clevis 15 holding the hammer 14, in each case. In the present apparatus the bumper holding means may conveniently take the form of a pair of substantially heavy or sturdy rectangular frame portions 38 having inwardly projecting lips 37, integrally formed with and extending in opposite directions from the ends of the central body portion 19 of each adapter block 13, the adapter blocks 13 being mounted on the hub 11 so that the rectangular frame portions 38 extend from the central body portion 19, in each case, along a peripheral line about the mace in the direction of rotation of the mace. The bumper 39 is a pad made of most any resilient, tough material, ordinarily polymeric, such as a high density polyurethane, and is shaped to have an enlarged body portion 40 larger than the frame opening, and a smaller body portion 41 extending through and protruding above the frame opening, the frame portions 38 being formed to extend sufficiently close in each case to the adjacent hub face 12 to retain the bumper 39 on a spacer 46 when the bumper is positioned in the frame portion 38 with the larger portion 40 below the opening of the frame and the adapter block fixedly attached to the hub face 12. The spaced 46, as shown in FIG. 2, is preferably attached to the hub face 12 with bolts 47 which engage tapped boreholes 48.

As seen in FIG. 2, the mace 10 preferably takes the form of a hub 11 having nested arrays of adapter blocks 13 held side by side on respective flat faces 12, or faced off portions of the hub is substantially round in section. Preferably, the adapter blocks 13 are positioned about the circumference of the hub 11 so that a substantially balanced or uniform weight load is achieved during rotation of the mace, as by distributing the rows of adapter block and hammer assemblies so that they are substantially equidistant around the periphery of the hub.

It has also been found convenient to provide indented portions 42 in each face 12 of the hub 11 and to form the adapter blocks 13 with extending boss portions 43 at substantially each end 44 of the central body portion 19 on the substantially faying face 20 thereof, the boss portions 43 and the indented face portions 42 having closely similar proportions with the indented portions 42 spaced only slightly further apart so that the boss portions 43 fit snugly into the indented portions 42 between the ends thereof so as to thereby index the adapter blocks 13 upon the faces 12 of the hub 11.

The present novel adapter block 13 for the pivotable attachment of a hammer 14 to the hub 11 of a rotary mace 10 for the removal of unwanted parts from castings is thus seen to comprise a body portion 19 having generally the shape of a rectangular solid, and first and second opposing faces 20 and 21, first and second ends and first and second lateral edges. The first opposing face 20 is adapted to fay against or be adjacent to a face 12 of the hub 11 of the rotary mace 10 with the first and second ends lying substantially co-aligned in the direction of rotation of the rotary mace 10, the body portion 19 having at least two boreholes, such as first and second boreholes 23 formed therethrough and adapted for fastening means, such as bolts 22, to extend therethrough into the faying surface 12 of the hub 11, usually into tapped boreholes 24 therein. In addition, third and fourth boreholes 27 extend from the second opposing face 21 at least substantially if not entirely to the first opposing face 20, the boreholes 27 being adpated to receive respectively the legs of a generally U-shaped clevis 15 for pivotably mounting a hammer 14 on the body portion 19, and the boreholes 27 being aligned along a peripheral line around the surface of the hub in the direction of rotation of the mace 10 when the ends of the portion 19 are likewise so-aligned. Also, fifth and sixth boreholes 29 extend at least substantially from one of the lateral edges 26 of the body portion 19 to the other edge thereof, the boreholes 29 extending, i.e., lying, between and apart from the planes of the first and second opposing faces 20 and 21, and the fifth and sixth boreholes 29 each respectively intercepting a portion only of the third and fourth boreholes 27 and being each adapted to receive a retaining pin 30 for the purpose of retaining a notched clevis leg 28 inserted in one of such third and fourth boreholes 27. More preferred aspects of the third and fourth borehole 27 have been described hereinabove, as well as the desirability of providing bumper means for the adapter block.

The most preferred material of construction for the adapter block 13 and the clevis 15 is a high tensile strength, impact resistant high speed tool steel. However, a high tensile strength, impact resistance lower alloy tool steel is highly preferred when initial cost is a factor. The preferred material of construction for the hub 11 is mild steel. The hammers 14 are preferably an abrasion and impact resistant hardened tool steel.

The adapter blocks 13, the clevises 15 and the hammers 14 are preferably formed by casting using the lost wax process. When the adapter block is cast by the lost wax process, the second and third boreholes 27 are preferably cast undersize and then reamed to final size. The other boreholes and openings such as the opening in the frame portions 38 of the central body portion 19, are preferably cast to final size. The boss portions 43 on the first opposing face 20 of the central body portion 19 are preferably cast oversize and then milled to their final dimensions. The number of hammers 14 associated with each adapter block is not critical to the invention and an adapter block 13a, as shown in FIG. 3, may be cast so that it holds two clevises 15 and thus is associated with two hammers 14. However, it is preferred to cast the adapter block to hold one clevis so that the retaining pins 30 are of minimum length and thus are more easily removed from the boreholes 29 after extensive normal operation of the mace 10. The spacer 46 is preferably made from mild steel as is the drive shaft 18.

When each adapter block is about 5.5 inches long and the hub of the mace is one that accommodates from four to six rows of adapter blocks with hammers thereon the rotary mace is rotated, preferably, at about 500 to 600 rpm.

Among the advantages of the present adapter block and the improved mace assembly including such adapter blocks are the protection of the hub from damage in most operations, and the ease and lower cost of replacing individual hammers and bumpers as they become damaged or lost from the mace as well as easier original installation of the clevises and hammers.

What is claimed is:

1. In an improved rotary mace comprising a hub having an axis of rotation and a peripheral, radially outward surface, at least one hammer, and means for pivotally but removably securing each hammer to the surface of the hub, wherein the improvement comprises: at least one adapter block for supporting the at least one hammer and means for fixedly but removably attaching each adapter block to the radially outward surface of the hub, each adapter block having a face which substantially contacts the surface of the hub and an opposed face, the means for pivotably but removably securing each hammer being attached to the opposed face of the associated adapter block upon which the hammer is borne.

2. The improvement of claim 1 wherein the means for securing each hammer to a respective adapter block is a clevis, each hammer having a foreshortened shank terminating in an eye, each clevis extending through one of the eyes and having legs extending into paired boreholes extending substantially in the normal direction into the face of the associated adapter block and means for retaining the legs of the clevis in the adapter block.

3. The improvement of claim 2 wherein the clevis legs are each notched and the boreholes in pairs in the face of each adapter block are spaced apart in the direction of rotation of the mace and are adapted to receive the legs of each such clevis therein.

4. The improvement of claim 3 wherein the means for retaining the clevis legs in each adapter block comprises, in combination, the notch in each of the clevis legs adjacent the distal end thereof and first and second pins extending through respective first and second transverse substantially parallel boreholes provided in each adapter block, the pins respectively being aligned so as to each intercept the respective notch in one of the legs of the clevises.

5. The improvement of claim 4 wherein the apparatus includes additionally means for retaining in the transverse boreholes in the adapter block the pins intercepting the notches in the legs of the clevises.

6. The improvement of claim 5 wherein the transverse boreholes extending through the adapter block have a larger diameter portion extending substantially from one lateral edge of the adapter block toward the other lateral edge and a smaller diameter substantially coaxial portion adjacent the other lateral edge and the first transverse borehole having such smaller diameter portion adjacent one lateral edge and the second transverse borehole having the smaller diameter portion adjacent the opposite lateral edge.

7. The improvement of claim 6 wherein the means for fixedly but removably attaching each adapter block to the hub and the means for retaining in the transverse boreholes in the adapter block the pin intercepting the notches in the legs of the clevises comprises two bolts each inserted through respective boreholes extending through the adapter block between opposing faces thereof and into tapped holes in the immediately adjacent outward surface of the hub, the boreholes being each aligned so that a diametric line thereof substantially intersects the diametric line of one of the transverse boreholes and each bolt having a head positioned substantially in alignment with the diametric line of a transverse borehole and adjacent the larger opening thereof so as to block transverse movement of said pins from the transverse boreholes.

8. The improvement of claim 7 wherein the adapter block is additionally provided with means adjacent each hammer thereon for holding a resilient bumper at each end of the adapter block along a peripheral line in the direction of rotation of the mace, in substantially each case the means being spaced from the clevis holding the hammer in a manner to hold such bumpers, respectively, at alternate positions to receive the impact of the hammer when it is pivoted to the maximum extent in either direction along the peripheral line.

9. An adapter block for the pivotable attachment of a hammer to the hub of a rotary mace for the removal of unwanted parts from castings, which comprises:

a body portion having generally the shape of a rectangular solid, and first and second opposing faces, first and second ends, and first and second lateral edges;

the first opposing face being adapted to fay substantially against a face of the hub of the rotary mace with the first and second ends lying substantially co-aligned in the direction of rotation of the mace, the body portion having at least one borehole formed therethrough and adapted to receive in slideable relationship fastening means extending therethrough into attachment means in the substantially faying face of the hub;

third and fourth boreholes extending into the body portion from the second opposing face, the third and fourth boreholes being each adapted to receive a leg of a U-shaped clevis for pivotably mounting a hammer on the body portion, and the third and fourth boreholes being aligned along a peripheral line in the direction of rotation of the mace when the ends of the body portions are likewise so-aligned; and fifth and sixth boreholes extending into the body portion from one of the lateral edges of the body portion toward the other lateral edge and lying between the first and second opposing faces thereof, the fifth and sixth boreholes, respectively, intercepting a portion only of the third and fourth boreholes and being each adapted to receive a retaining pin for the purpose of retaining a notched clevis leg inserted in one of such third and fourth boreholes.

10. The adapter block of claim 9 wherein the body portion has two boreholes formed therethrough adapted to receive in slidable relationship fastening means extending therethrough into attachment means in the substantially faying face of the hub.

11. The adapter block of claim 10 having means at each of the first and second ends of the body portion for holding resilient bumper means positioned to receive the impact of the hammer pivotably held by the clevis mounted in the third and fourth boreholes.

12. The adapter block of claim 11 wherein the means for holding a resilient bumper means at the first and second ends is in each case a sturdy frame member portion integrally formed with the body portion and having an opening therethrough defined by the frame member portion, the frame member portion extending from the body portion in a manner so as to provide substantial clearance between the frame member and the plane of the first opposed face of the body portion for positioning a resilient bumper pad within the frame member opening with a larger portion thereof between the frame member and the plane.

13. The adapter block of claim 12 wherein the first and second boreholes for fastening means to extend through and into retaining means in the face of the hub on which the adapter block is to be mounted are formed, respectively, in and through rounded lateral flanges extending, respectively from the first and second lateral edges, the flanges extending substantially only sufficient to accommodate the first and second boreholes and the flanges being mutually offset from diametric lines passing through the first and second boreholes which extend transversely to the body portion, whereby adapter blocks having such lateral flanges nest efficiently side by side in close spaced relationship when mounted on the hub of a mace.

14. The adapter block of claim 9 having additionally means for the pivotal attachment of a second hammer, the means for pivotal attachment thereof being positioned and disposed to provide for substantially parallel side by side pivoting of both hammers.

* * * * *